US005937775A

United States Patent [19]

Ku

[11] Patent Number: 5,937,775

[45] Date of Patent: Aug. 17, 1999

[54] SEWING MACHINE CONTROL DEVICE HAVING ELECTRICALLY MOVABLE CONNECTING BAND EXTENDING ABOUT ROLLER FOR PRESSER FOOT LIFTING

[76] Inventor: Fei-Lung Ku, No. 10, Alley 6, Lane 148, Kai Yuan Road, Tainan, Taiwan

[21] Appl. No.: 09/163,320

[22] Filed: Sep. 30, 1998

[51] Int. Cl.[6] ..... D05B 29/02; D05B 69/10

[52] U.S. Cl. ..... 112/239

[58] Field of Search ..... 112/237, 238, 112/239, 220

[56] References Cited

U.S. PATENT DOCUMENTS

| | | | |
|---|---|---|---|
| 4,246,856 | 1/1981 | Sansone et al. | 112/239 |
| 4,676,179 | 6/1987 | Nomura et al. | 112/239 |

FOREIGN PATENT DOCUMENTS

| | | | |
|---|---|---|---|
| 61-82788 | 4/1986 | Japan | 112/237 |
| 4-26459 | 1/1992 | Japan | 112/237 |

*Primary Examiner*—Peter Nerbun
*Attorney, Agent, or Firm*—Rosenberg, Klein & Bilker

[57] ABSTRACT

A sewing machine includes a position rod fixed under a plate base for securing an electromagnet horizontally. The position rod has a front end holding a roller for a connecting band to extend around. The lower end of the connecting band is bound with a working rod of the electromagnet. In using the sewing machine, the electromagnet is electrically activated or desactivated to attract the working rod to the left side or the right side for pulling or not pulling the connecting band and a swing arm so as to lift or lower the presser foot. Thus the space for installing the electromagnet can be narrowed and the power required by itself may be decreased.

5 Claims, 6 Drawing Sheets

SEWING MACHINE CONTROL DEVICE HAVING ELECTRICALLY MOVABLE CONNECTING BAND EXTENDING ABOUT ROLLER FOR PRESSER FOOT LIFTING

BACKGROUND OF THE INVENTION

This invention relates to a sewing machine, particularly to an improvement of a presser foot control device for narrowing the space of the device occupied and decreasing the power when an electromagnet works.

The presser foot of a sewing machine is designed to keep cloth flat and wrinkleless and moves the cloth smoothly by means of a feed dog. Lifting and lowering of the presser foot is effected by up-and-down movement of a working rod of an electromagnet placed vertically under a plate base.

The detailed structure of the electromagnet and working rod is shown in FIG. 6. The electromagnet 20 is is positioned vertically under the plate base 10, secured on a position plate 30 fixed with plural position posts 101 extending down from the plate base 10. The position plate 30 has a vertical ear 301 at an end and pivotally connected to a middle section of a lever rod 302, which has a slot 303 at one end for a pin 304 to insert through and connected with a working rod 201 of the electromagnet 20. Further, the lever rod 302 has the other end connected to a lower end of a connecting means 40 such as a chain. The connecting means 40 passes through the plate base 10 and has an upper end connected to a swinging arm 50 that is connected to a moving device of the main mechanism 60. The moving device moves the presser foot 70. When the presser foot 70 is above the surface of the slide plate 80, a pedal is able to be stepped on to electrify the electromagnet 20 to pull up the working rod 201, with the left end of the lever rod 302 pulled up to cause the right end of the lever rod 302 move down and pull down the connecting band 40. Then the swing arm 50 swings down, with the presser foot 70 lifted up by the moving device. On the contrary, when the pedal is no longer stepped on, the electromagnet 20 is not electrified, freeing the working rod 201 to slide down, with the presser foot 70 moving down by means of the lever rod 302, the connecting band 40 and the swing arm 50 being interconnected to one another.

However, when the working rod 201 is pulled inward (i. e. moving up), the weight of the magnet in the electromagnet 20 plus the gravitational force, and friction associated with lever rod 302, the connecting band 40, the swing arm 50, etc., i.e. the force of lifting the working rod 201 is substantially high so that the power required by the electromagnet 20 will be large. In addition, the electromagnet 20 may be hit by a leg of a user, as the electromagnet 20 is positioned vertically the plate base 10, or the user may worsen his/her bodily posture by trying to avoid the electromagnet 20. Besides, the working rod 201 of the electromagnet 20 is connected to the slot 303 of the lever rod 302 by means of the pin 304, so when the working rod 201 is retracted the pin 304 is liable to slide in the slot 303, wasting the power of the electromagnet 20. The sliding back-and-forth movement of the pin 304 in the slot 303 forms a kind of friction to waste the power of the electromagnet as well.

SUMMARY OF THE INVENTION

The main purpose of the invention is an improvement of the presser foot control device of a sewing machine, by positioning the electromagnet in a horizontal direction instead of the vertical direction used in common sewing machines. In addition, the power consumed by the electromagnet decreases.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
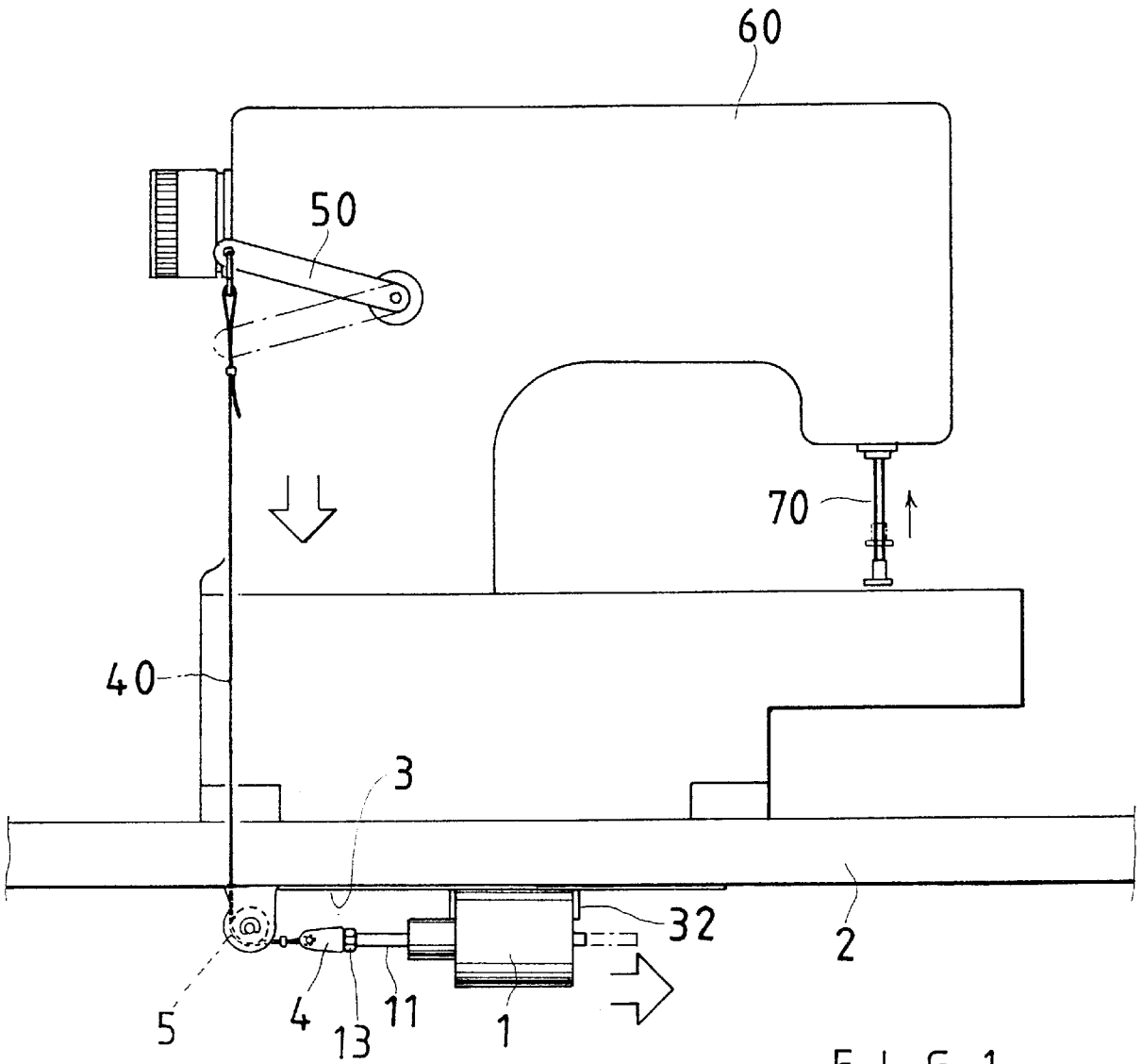
FIG. 1 is a side view of a sewing machine of the present invention, showing how it is operated.

A preferred embodiment of a sewing machine in the present invention, as shown in FIG. 1, includes a plate base 2, a main mechanism 60 fixed firmly on the plate base 2, and an electromagnet 1 positioned horizontally under the plate base 2, which is a main feature of the present invention. The electromagnet 1 occupies smaller dimensions than that of a conventional sewing machine, and further decreases the power of the electromagnet 1 required, very practical in use.

Figure 2:
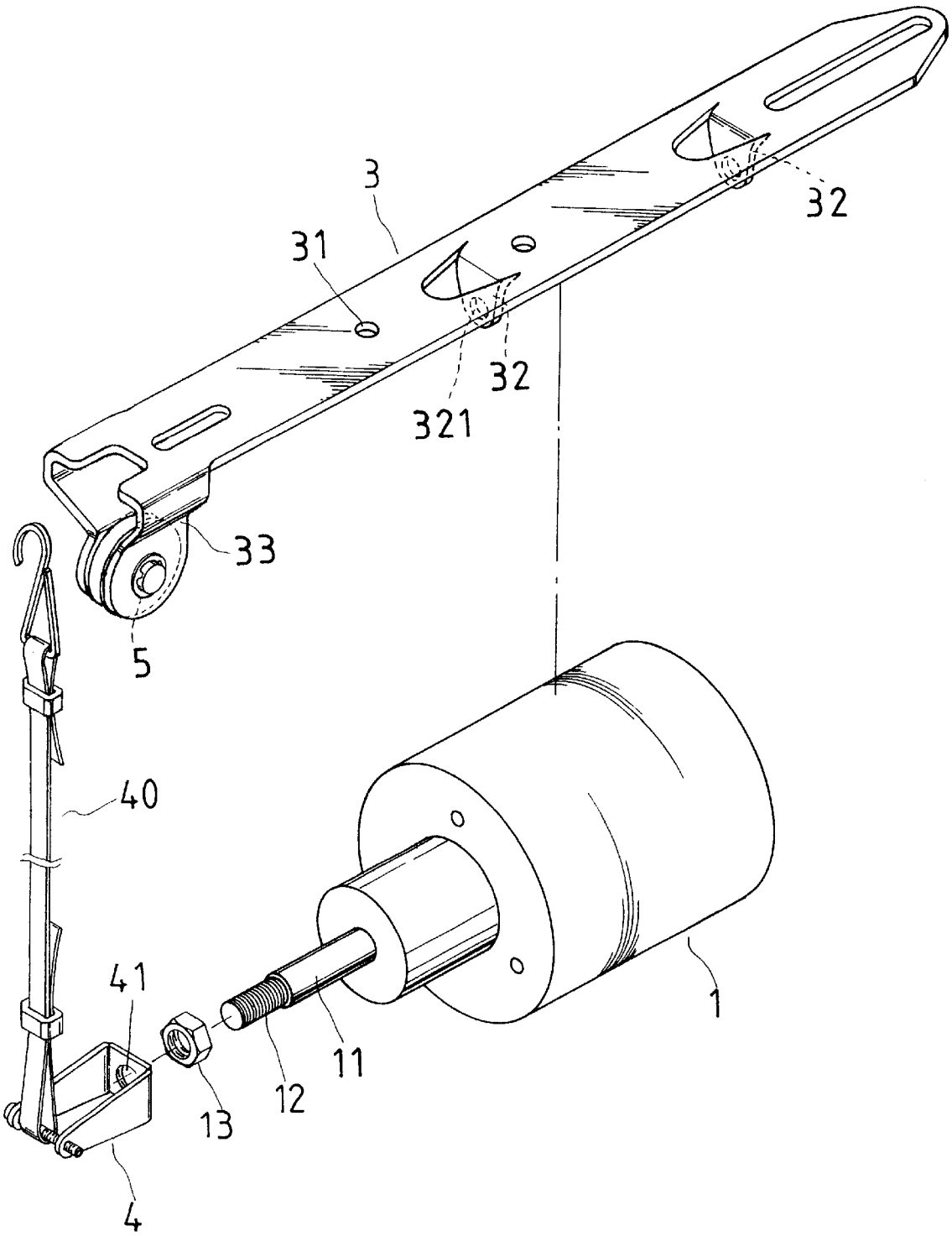
FIG. 2 is an exploded perspective view of the feature of the sewing machine of the present invention.

Referring to FIGS. 1 and 2, this invention has a position rod 3 provided with several holes 31 spaced apart and two ears 32 bending vertically down from its flat body and respectively provided with a hole 321. The holes 31 are for screws to fit through to fix the position rod 3 on a lower surface of the plate base 2. The electromagnet 1 is positioned between the two ears 32 and secured in the position with screws fitting through the holes 321. Then the working rod 11 of the electromagnet 1 has a front end fixed firmly with a rear end of a connector 4. The position rod 3 further has two opposing bent-down walls 33 formed at a front end, and a roller 5 combined with the two opposing bent-down walls 33. A connecting band 40 has a lower end bound on the connector 4 and an upper end bound on a hook, vertically resting the roller 5 to move up and down smoothly. The working rod 11 of the electromagnet 1 has threads 12 formed in the front end and fixed to the connector 4 with a nut 13 engaging the threads 12 after fitting through a hole 41 of the connector 4.

In operating the sewing machine of the invention, when the presser foot 70 is lifted up, the pedal is pressed to electrify the electromagnet 1. Then the working rod 11 is attracted to the right side, pulling the connecting band 40 down, with a swing arm 50 connected with the hook bound with the upper end of the connecting band 40 being swung down at the same time. Thus a related device of the main mechanism 60 (a well-known art, not described here) is then moved to lift the presser foot 70.

If the pedal is released, no longer pressed down, the electromagnet 1 is no longer electrified, let the working rod 11 to move back to the left side, with the connecting band 40 no longer pulled down, with the swing arm 50 also returning to its original position, and with the presser foot 70 also moving down to its original position.

Figure 3:
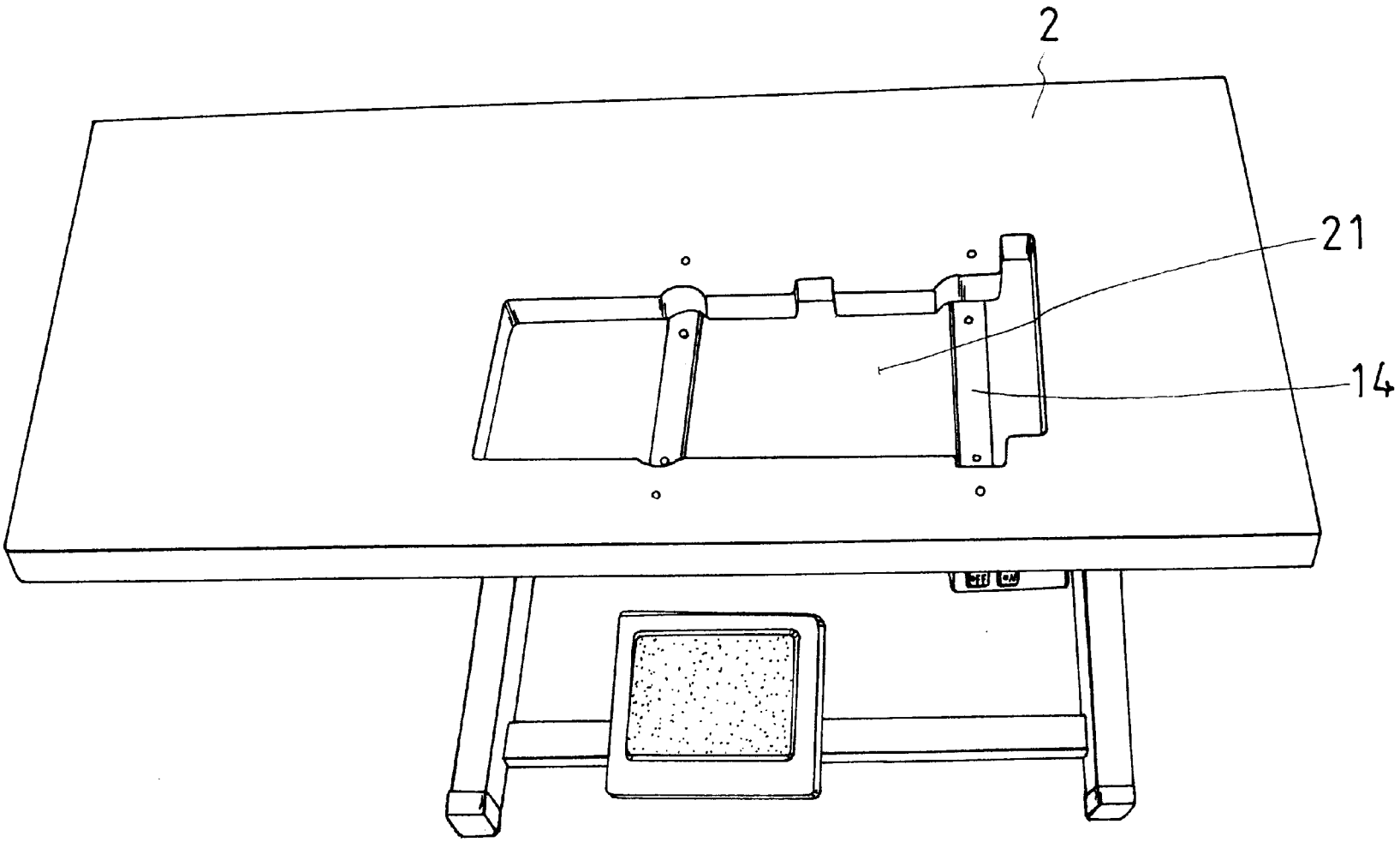
FIG. 3 is a perspective view of another plate base of the sewing machine of the present invention.
Figure 4:
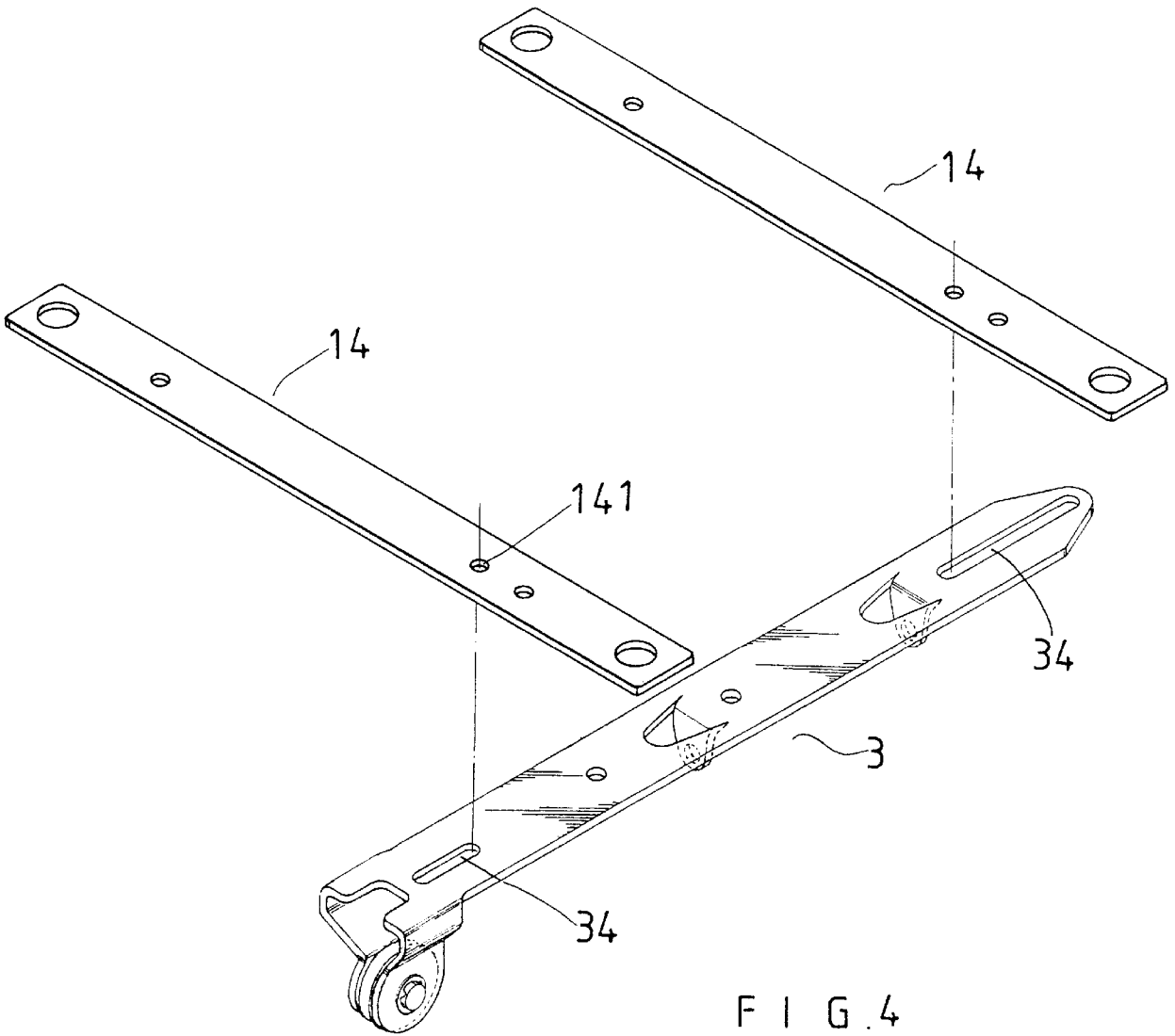
FIG. 4 is a perspective view of a position rod and two flat strips of the present invention.
Figure 5:
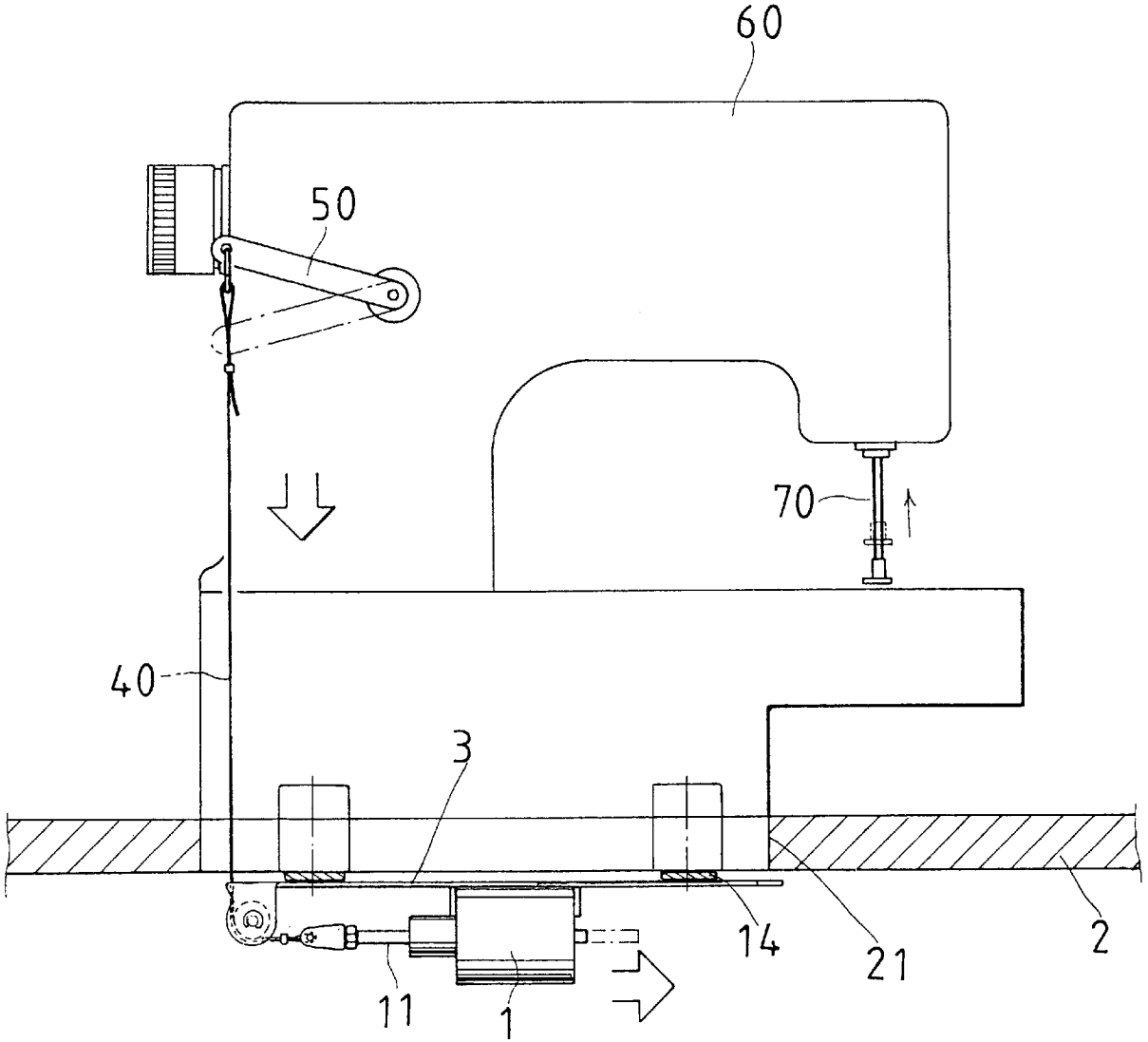
FIG. 5 is a side view of another plate base of a sewing machine of the present invention; and, FIG. 6 is a side view of a conventional sewing machine.
Figure 6:
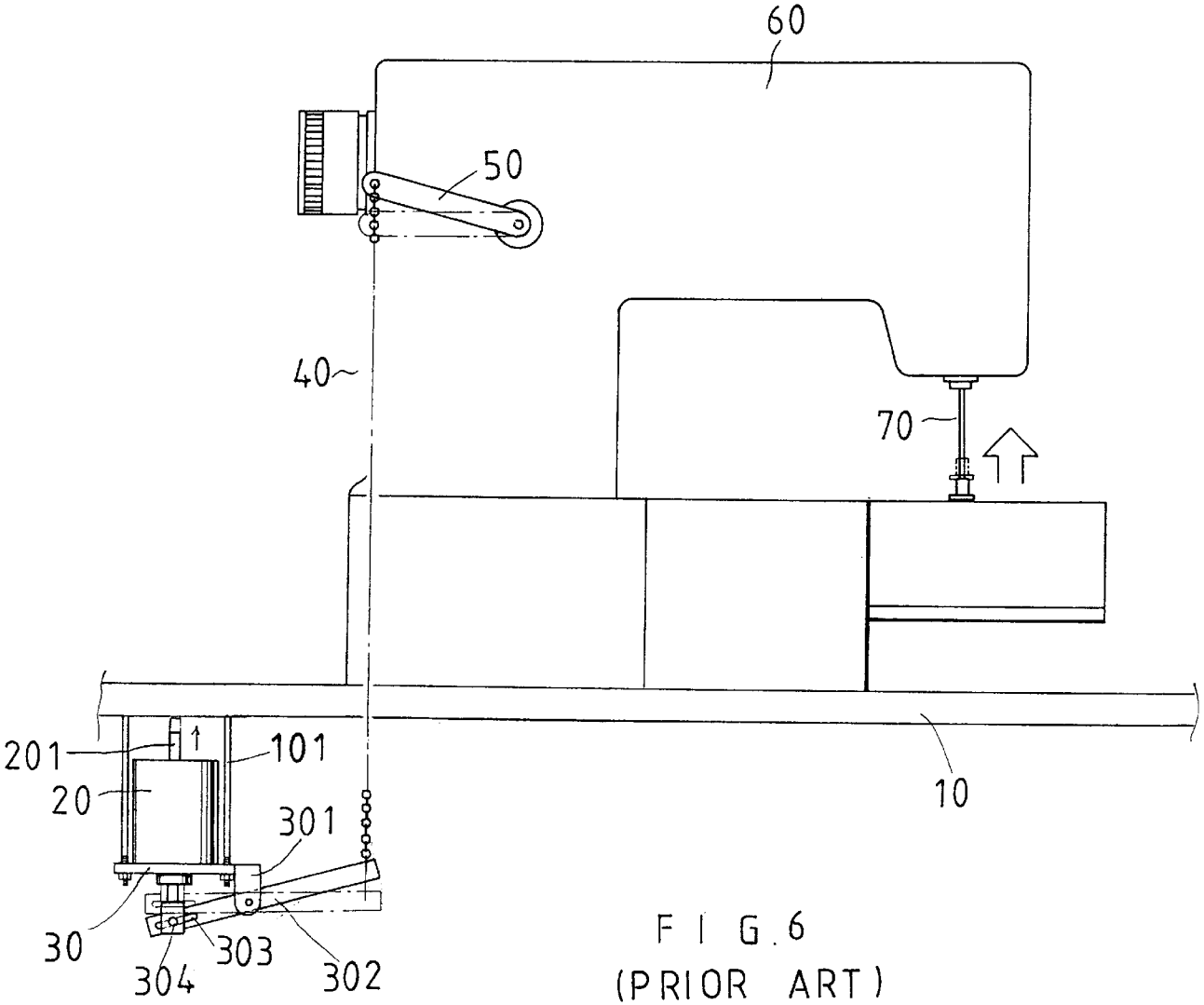
FIG. 6 (PRIOR ART)

Next, referring to FIGS. 3, 4 and 5, in case a sewing machine is different from that described above, having a hole 21 formed in the plate base 2 below the main mechanism 60, two parallel flat strips 14 are provided to be screwed on the lower surface of the plate base 2. Then the bottom of the main mechanism 60 may be positioned in the hole 21 directly on the two parallel flat strips 14 and secured with screws in that position. The position rod 3 further has a slot 34 at two end portions and the two flat strips 14 further have a threaded hole 141 respectively at two end portions. Then the position rod 3 is placed under said two flat strips 14, with the slots 34 respectively facing and secured tightly with the threaded holes 141 with screws. After that, the position rod 3 is fixed properly under the plate base 2. However, the distance between the two flat strips 14 may be adjusted through use of the slots 34 in accordance with different types of sewing machines.

As can be understood from the aforesaid description, the sewing machine in the present invention has the following advantages.

1. The working rod of the electromagnet is not affected by the gravitational force, not adding its weight because of its horizontal position during its movement, saving power consumed to electrify the electromagnet.

2. Provision of the-roller can smooth movement of the connecting band, reducing friction between both, and saving force applied to the working rod of the electromagnet.

3. The horizontal position of the electromagnet may narrow the required space for it, and a user may not be forced to worsen his/her bodily posture possibly caused by a vertical position of the electromagnet of a common sewing machine.

4. Provision of the position rod enables the control device of the pressure foot to be applied to any type of sewing machines.

What is claimed is:

1. A sewing machine comprising a plate base, a main mechanism fixed above said plate base, said main mechanism having a swing arm, a presser foot control device moving said swing arm with a connecting band, said presser foot being lifted up by a moving device of said main mechanism, said moving device comprising a position rod fixed under a lower surface of said plate base, an electromagnet secured horizontally under said position rod, a roller rotatably held at a front end of said position rod for a connecting band to extend around, said electromagnet having a working rod to move back and forth; said electromagnet being electrically activated or deactivated to attract said working rod to move back or move forward, pulling said connecting band and said swing arm down or allowing said connecting band and swing arm to return to an original position so that said presser foot may be lifted up or lowered down, the space for said electromagnet thus being narrowed and power required for said electromagnet being decreased.

2. The sewing machine as claimed in claim 1, wherein said position rod has several holes for screws to fix said position rod on a lower surface of said plate base.

3. The sewing machine as claimed in claim 1, wherein said position rod has two bending-down ears spaced apart properly for securing firmly said electromagnet between said two ears with screws.

4. The sewing machine as claimed in claim 1, wherein said working rod of said electromagnet has its front end formed with threads and screws with a nut after said front end with said threads passes through a hole of a connector; said nut may be screwed to move near or far from the connector so as to adjust tightness of the working rod with the connector, with said connector connecting said working rod with said connecting band.

5. The sewing machine as claimed in claim 1, wherein if a sewing machine has a plate base provided with a hole to receive a bottom of said main mechanism, plural flat strips are provided to be fixed on a lower surface of said plate base, and said main mechanism has its bottom fitted in said hole and placed on said plural flat strips; said position rod further having a slot respectively formed in two ends thereof, and placed under said flat strips and screwed tightly together with screws engaging the slot and threaded holes in said flat strips so as to position said position rod under said plate base properly.

* * * * *